US005414412A

United States Patent [19]

Lian

[11] Patent Number: 5,414,412

[45] Date of Patent: May 9, 1995

[54] FREQUENCY DIVIDING TRANSPONDER, INCLUDING AMORPHOUS MAGNETIC ALLOY AND TRIPOLE STRIP OF MAGNETIC MATERIAL

[75] Inventor: Ming R. Lian, Clearwater, Fla.

[73] Assignee: Security Tag Systems, Inc., Deerfield Beach, Fla.

[21] Appl. No.: 78,745

[22] Filed: Jun. 16, 1993

[51] Int. Cl.[6] ..... G08B 13/14

[52] U.S. Cl. ..... 340/572; 327/117; 327/510

[58] Field of Search ..... 340/572; 307/219.1

[56] References Cited

U.S. PATENT DOCUMENTS 4,727,360 2/1988 Ferguson et al. ..... 340/572
4,882,569 11/1989 Dey ..... 340/572
4,968,972 11/1990 Canipe ..... 340/551

*Primary Examiner*—Brent Swarthout
*Assistant Examiner*—Thomas J. Mullen, Jr.
*Attorney, Agent, or Firm*—Edward W. Callan

[57] ABSTRACT

In an electronic article surveillance (EAS) system, a frequency-dividing transponder that responds to detection of electromagnetic radiation of a first predetermined frequency by transmitting electromagnetic radiation of a second predetermined frequency that is a frequency-divided quotient of the first predetermined frequency, includes an active strip of amorphous magnetic material having a transverse uniaxial anisotropy defining a magnetomechanical resonant frequency in accordance with the dimensions of the strip at the second predetermined frequency when magnetically biased to be within a predetermined magnetic field intensity range so as to respond to excitation by electromagnetic radiation of the first predetermined frequency by transmitting electromagnetic radiation of the second predetermined frequency; and a tripole strip of magnetic material of such coercivity and so disposed in relation to the active strip of magnetic material as to create a magnetomechanical resonance in the active strip at the first predetermined frequency when the active strip is magnetically biased to be within the predetermined magnetic field intensity range. The transponder may also include a bipolar bias strip of such coercivity and so disposed in relation to the active strip as to cause the active strip to be within the predetermined magnetic field intensity range at which the active strip has magnetomechanical resonance at the first and second predetermined frequencies.

11 Claims, 2 Drawing Sheets

FIG. 1
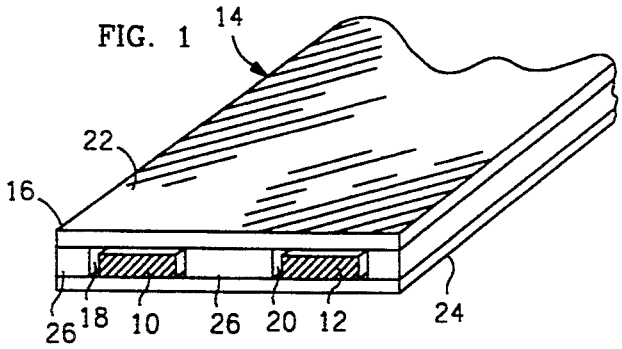
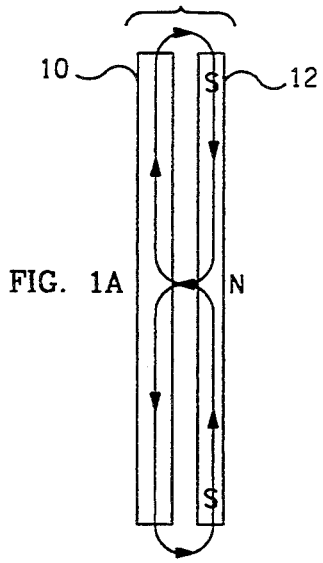
FIG. 1A
FIG. 2
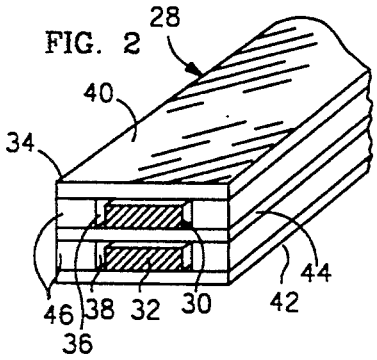
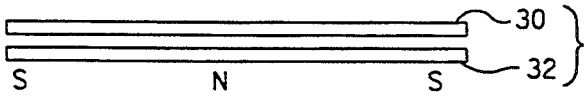
FIG. 2A
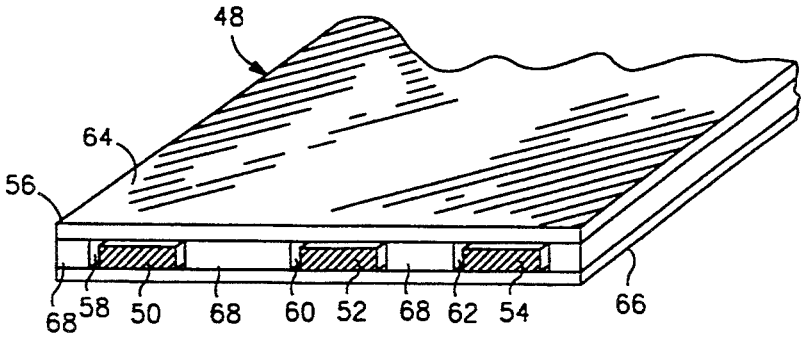
FIG. 3
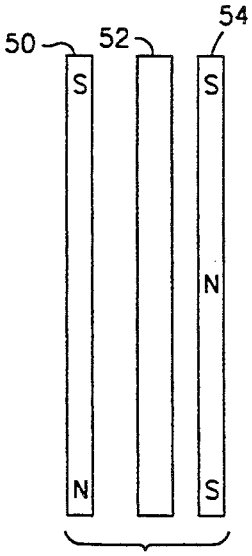
FIG. 3A
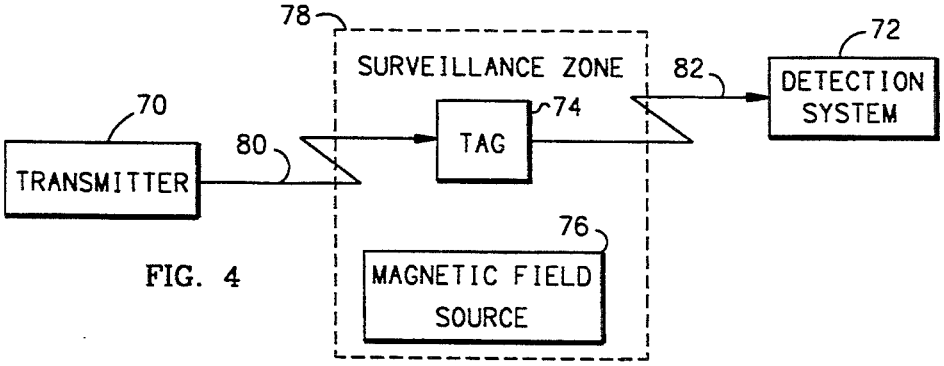
FIG. 4

FREQUENCY DIVIDING TRANSPONDER, INCLUDING AMORPHOUS MAGNETIC ALLOY AND TRIPOLE STRIP OF MAGNETIC MATERIAL

BACKGROUND OF THE INVENTION

The present invention generally pertains to frequency-dividing transponders of the type that detects electromagnetic radiation of a first predetermined frequency and responds to said detection by transmitting electromagnetic radiation of a second predetermined frequency that is a frequency-divided quotient of the first predetermined frequency.

The present invention is particularly directed to improving the efficiency of initiating frequency division in such type of frequency-dividing transponder that includes an active strip of amorphous magnetic material having a transverse uniaxial anisotropy defining a magnetomechanical resonant frequency in accordance with the dimensions of the strip at the second predetermined frequency when magnetically biased to be within a predetermined magnetic field intensity range so as to respond to excitation by electromagnetic radiation of the first predetermined frequency by transmitting electromagnetic radiation of the second predetermined frequency, as described in U.S. Pat. No. 4,727,360 to Lucian G. Ferguson and Lincoln H. Charlot, Jr. The transponder described in said Patent further includes a bipolar bias strip of magnetic material of such coercivity and so disposed in relation to the active strip of magnetic material as to cause the active strip of magnetic material to be within the predetermined magnetic field intensity range. The transponder is used as a component of a tag that is attached to an article to be detected within a surveillance zone of a presence detection system, such as an electronic article surveillance (EAS) system utilized for theft deterrence. The presence detection system further includes means for transmitting electromagnetic radiation of a first predetermined frequency into a surveillance zone and means for detecting electromagnetic radiation of the second predetermined frequency within the surveillance zone.

SUMMARY OF THE INVENTION

The present invention provides a frequency-dividing transponder for detecting electromagnetic radiation of a first predetermined frequency and responding to said detection by transmitting electromagnetic radiation of a second predetermined frequency that is a frequency-divided quotient of the first predetermined frequency, comprising an active strip of amorphous magnetic material having a transverse uniaxial anisotropy defining a magnetomechanical resonant frequency in accordance with the dimensions of the strip at the second predetermined frequency when magnetically biased to be within a predetermined magnetic field intensity range so as to respond to excitation by electromagnetic radiation of the first predetermined frequency by transmitting electromagnetic radiation of the second predetermined frequency; and a tripole strip of magnetic material of such coercivity and so disposed in relation to the active strip of magnetic material as to create a magnetomechanical resonance in the active strip at the first predetermined frequency when the active strip is magnetically biased to be within the predetermined magnetic field intensity range.

By causing the active strip to also have a magnetomechanical resonance at the first predetermined frequency, the electromagnetic radiation at the first predetermined frequency may be provided at a lower radiation intensity level, whereby the efficiency of the transponder in initiating frequency division is greatly enhanced in comparison to the efficiency of the transponder described in the aforementioned U.S. Pat. No. 4,727,360, in which the active strip has a magnetomechanical resonance at only the second resonant frequency.

The present invention further provides a theft prevention system including the above-described frequency-dividing transponder.

Additional features of the present invention are described in relation to the detailed description of the preferred embodiments.

BRIEF DESCRIPTION OF THE DRAWING

FIG. 1 is a fragmentary perspective view of a preferred embodiment of tag containing a frequency-dividing transponder according to the present invention, wherein a portion of the tag is cut away.

FIG. 1A is a top view showing the positioning of the active strip and the tripole strip within the housing of the tag of FIG. 1, and further showing magnetic flux extending from the tripole strip to the active strip.

FIG. 2 is a fragmentary perspective view of an alternative preferred embodiment of a tag containing a frequency-dividing transponder according to the present invention, wherein a portion of the tag is cut away.

FIG. 2A is a side view showing the positioning of the active strip and the tripole strip within the housing of the tag of FIG. 2.

FIG. 3 is a fragmentary perspective view of a tag containing a frequency-dividing transponder according to the present invention, wherein a portion of the tag is cut away.

FIG. 3A is a top view showing the positioning of the active strip, the tripole strip and a bias strip within the housing of the tag of FIG. 3.

FIG. 4 is a diagram of a preferred embodiment of a presence detection system according to the present invention.

DETAILED DESCRIPTION

Figure 5:
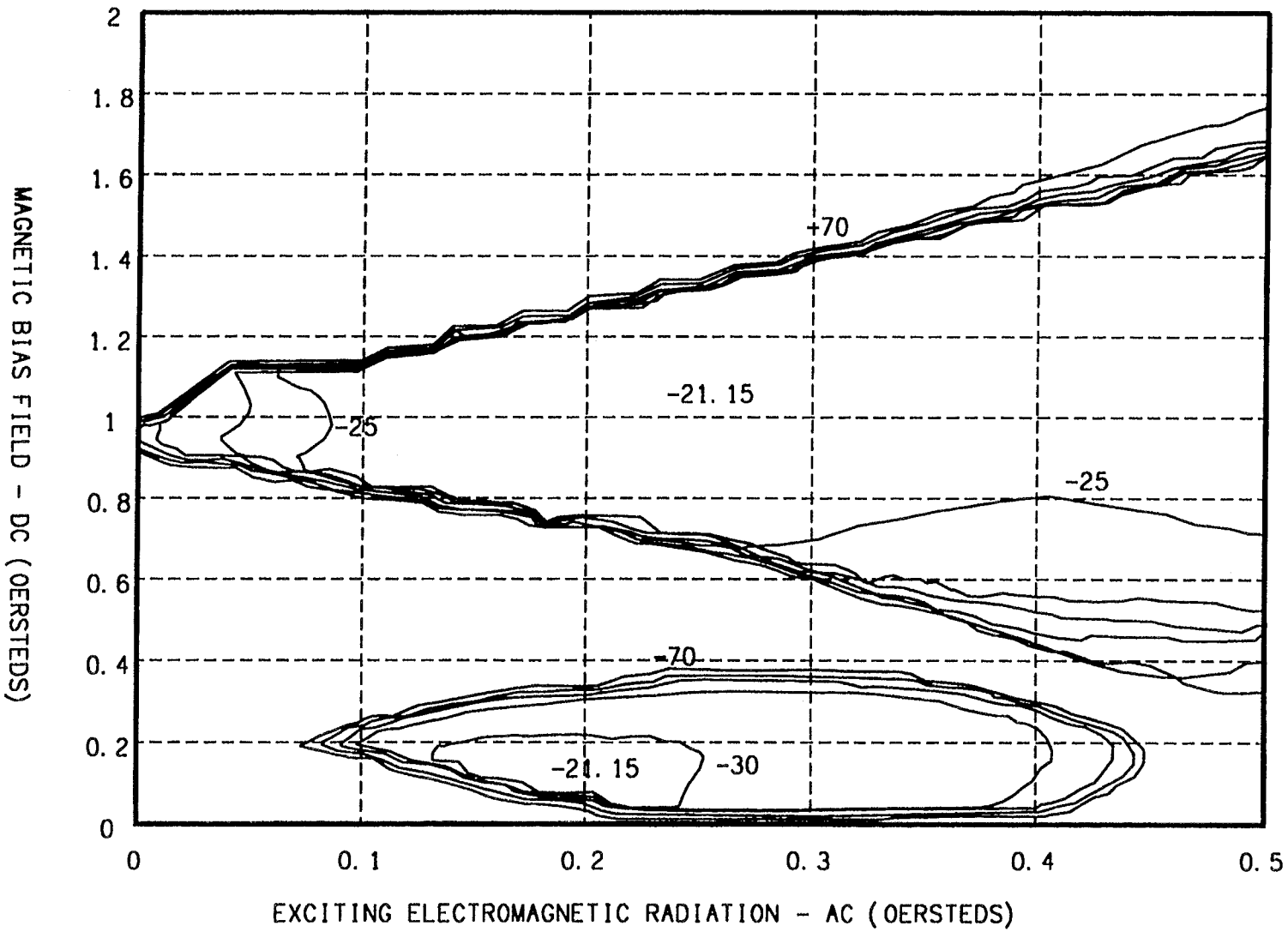
FIG. 5 is a contour plot of the frequency-divided response of the transponder of the present invention at the second predetermined frequency as a function of both the intensity of the magnetic bias field and the intensity of the exciting electromagnetic radiation at the first predetermined frequency.

In one preferred embodiment, as shown in FIGS. 1 and 1A, a transponder including an active strip 10 of amorphous magnetic material and a tripole strip 12 of magnetic material is contained within a tag 14.

The active strip 10 is an elongated thin flat ribbon of low coercivity magnetostrictive amorphous magnetic material having a transverse uniaxial anisotropy defining a magnetomechanical resonant frequency in accordance with the dimensions of the ribbon at the second predetermined frequency when magnetically biased to be within a predetermined magnetic field intensity range so as to respond to excitation by electromagnetic radiation of the first predetermined frequency by transmitting electromagnetic radiation of the second predetermined frequency. The amorphous magnetic material is selected from a group consisting of $Fe_{40}Ni_{38}Mo_4B_{18}$, $Fe_{82}B_{12}Si_6$, $Fe_{81}B_{13.5}Si_{3.5}C_2$ and $Fe_{67}Co_{18}B_{14}Si_1$. The active strip has said uniaxial anisotropy as a result of being annealed in a transverse magnetic field of at least one kiloGauss. Further information relevant to preparation of the active strip 10 is described in the aforementioned U.S. Pat. No. 4,727,360.

The tripole strip 12 of magnetic material is of such coercivity and so disposed in relation to the active strip 10 of magnetic material as to create a magnetomechanical resonance in the active strip 10 at the first predetermined frequency. The tripole strip 12 is a 0.65 to 1.0 percent-carbon steel ribbon or wire having a coercivity of at least 15 Oersteds so that the tripole configuration of the tripole strip 12 will not be altered by a stray ambient magnetic field. Preferably, the coercivity of the tripole strip 12 is within a range of from 15 to 200 Oersteds. The tripole strip 12 has a pole of one polarity, North or South, at each end of the strip 12 and a pole of the opposite polarity midway between the ends of the strip 12 as a result of closely passing a magnet laterally over the strip 12 at the midpoint of the strip 12, as described in U.S. Pat. No. 4,968,972 to Larry K. Canipe.

If the magnetic strength of the tripole strip 12 is too strong, the active strip 10 will experience a pinning effect, which reduces the magnetomechanical resonance in the active strip 10 at the first predetermined frequency.

The tripole strip 12 is disposed side by side and parallel to the active strip 10 with the midpoint, and thus the odd pole, of the tripole strip 12 aligned with the midpoint of the active strip 10 and at such distance from the active strip 10 in accordance with the coercivity of the tripole strip 12 that the magnetic flux 15 emanating in opposite directions from the odd pole of the tripole strip 12 passes through the opposite end halves of the active strip 10 in opposite directions, as shown in FIG. 1A. Because the opposite end halves of the active strip 10 are respectively subjected to the oppositely oriented magnetic fields emanating from the tripole strip 12, the active strip 10 is effectively divided into opposite end halves that are under distinctively different magnetic influences so that when the active strip 10 is magnetically biased to be within the predetermined magnetic field intensity range, the opposite end halves of the active strip 10 each have a magnetomechanical resonance at the first predetermined frequency, which is twice the second predetermined frequency associated with the full length of the active strip 10. The active strip 10 responds to electromagnetic radiation of the first predetermined frequency by vibrating in a length-extensional mode, with such vibration being at the second predetermined frequency over the full length of the active strip 10 and at the first predetermined frequency in each opposing end half of the active strip 10.

The tag 14 includes a housing 16 defining cavities 18 and 20 for containing the active strip 10 and the tripole strip 12 respectively. The housing includes a paper cover 22, a paper base 24 and paper spacers 26. The active strip 10 must be able to vibrate freely inside the housing cavity 18 without interference or restriction, and must have no mechanical stress impressed on the active strip 10 from the walls of the cavity 18. An exception to this requirement would be to fix the active strip 10 with a bead of adhesive at the center nodal point of the active strip 10. The dimensions of the cavity 18 need be only slightly larger than the dimensions of the active strip 10. The tripole strip 12 does not need to move freely and can be attached directly to the housing 16 with an adhesive and/or sandwiched between the cover 22 and the base 24 of the housing 16.

In an alternative preferred embodiment of a tag 28 containing a frequency-dividing transponder according to the present invention, as shown in FIGS. 2 and 2A, an active strip 30 of amorphous magnetic material is disposed back to back with a tripole strip 32 of magnetic material, instead of side by side, as in the embodiment of FIGS. 1 and 1A. The tag 28 includes a housing 34 defining cavities 36 and 38 for containing the active strip 30 and the tripole strip 32 respectively. The housing 34 includes a paper cover 40, a paper base 42, a paper intermediate layer 44 and paper spacers 46. In other respects the tag 28 and the frequency-dividing transponder contained therein are constructed and function in the same manner as the tag 14 and the frequency-dividing transponder in the embodiment of FIGS. 1 and 1A.

In another alternative preferred embodiment of a tag 48 including a frequency-dividing transponder according to the present invention, as shown in FIGS. 3 and 3A, the transponder includes a bipolar bias strip 50 of magnetic material in addition to an active strip 52 of amorphous magnetic material and a tripole strip 54 of magnetic material. The bias strip 50 is a 0.65 to 1.0 percent-carbon steel ribbon or wire having a coercivity of at least 15 Oersteds. The bias strip 50 has a pole of one polarity, Noah or South, at one end of the bias strip 50 and a pole of the opposite polarity at the opposite end of the bias strip 50. The bias strip 50 is of such coercivity and so disposed in relation to the active strip 52 as to cause the active strip 52 to be within the predetermined magnetic field intensity range at which the active strip 52 has magnetomechanical resonance at the first and second predetermined frequencies.

The tag 48 includes a housing 56 defining cavities 58, 60 and 62 for containing the bias strip 50, the active strip 52 and the tripole strip 54 respectively. The housing 56 includes a paper cover 64, a paper base 66 and paper spacers 68. The active strip 52 is disposed parallel to, side by side, and between the tripole strip 54 and the bias strip 50. In other respects the tag 48 and the frequency-dividing transponder of this embodiment are constructed and function in the same manner as the tag 14 and the frequency-dividing transponder in the embodiment of FIGS. 1 and 1A.

In an example of the preferred embodiment of FIGS. 3 and 3A, the active strip 52 is a ribbon of $Fe_{40}Ni_{38}Mo_4B_{18}$, which is designated as METGLAS 2826MB by its manufacturer, Allied Signal Corporation. The active strip 52 is 1.8 inches long, 0.8 mil thick and 138 mils wide. To provide uniaxial anisotropy, the active strip 52 is annealed in a transverse magnetic field of one kiloGauss at a temperature of 400 degrees Centigrade for three minutes. Each of the bias strip 50 and the tripole strip 54 is 1.8 inches long, 3 mils thick and 100 mils wide and has a coercivity of 25 Oersteds. The active strip 52 is spaced 175 mils from the bias strip 50 and 100 mils from the tripole strip 54. These spacing distances may vary if the magnetic strengths of the bias strip 50 and the tripole strip 54 vary.

Referring to FIG. 4, a presence detection system according to the present invention includes a transmitter 70, a detection system 72 and a tag 74, such as described above with reference to FIGS. 1 and 1A, 2 and 2A or 3 and 3A. When the tag 74 does not include means for providing a magnetic field within the predetermined magnetic field intensity range, such as provided by the bias strip 50 in the embodiment of FIGS. 3 and 3A, the presence detection system also includes a magnetic field source 76 disposed adjacent or within the surveillance zone 78.

The magnetic field source 76 provides a magnetic bias field within the predetermined magnetic field intensity range within a surveillance zone 78 so that when a tag 74 having a transponder in accordance with either of the embodiments of FIGS. 1 and 1A or FIGS. 2 and 2A is within the surveillance zone 78, the active strip 10, 30 of the transponder is within the predetermined magnetic field intensity range. The magnetic field source 76 may be an elongated electromagnetic bar magnet constructed of high flux density materials, which is coupled to a signal source for transmitting electromagnetic radiation at a relatively low frequency of between 1 and 100 Hertz. Alternatively, the magnetic field source 76 may be a rectangular coil disposed around the periphery of the surveillance zone 78 and coupled to a low-frequency signal source.

The transmitter 70 transmits electromagnetic radiation 80 of a first predetermined frequency in the kilohertz band into the surveillance zone 78.

The tag 74 is attached to an article (not shown) that is to be detected when within the surveillance zone 78. When within the surveillance zone 78, the transponder in the tag 74 detects electromagnetic radiation of the first predetermined frequency and responds to said detection by transmitting electromagnetic radiation 82 of a second predetermined frequency that is a frequency-divided quotient of the first predetermined frequency.

The detection system 72 detects electromagnetic radiation of the second predetermined frequency within the surveillance zone 78, and thereby detects the presence of the tag 74 within the surveillance zone 78 when the transponder of the tag 74 transmits electromagnetic radiation of the second predetermined frequency.

The sensitivity of the transponder of the present invention is graphically illustrated by the contour plot of FIG. 5, in which the abscissa is scaled to the intensity of the exciting electromagnetic radiation at the first predetermined frequency and the ordinate is scaled to the intensity of the magnetic bias field. The maximum frequency-divided response of the transponder of the present invention at the second predetermined frequency is −21.15 dB. Beyond −70 dB, a frequency-divided response is not initiated. It is seen from the plot of FIG. 5 that detectable frequency division is initiated at an exciting field intensity level of below 0.01 Oersteds; whereas in the prior art transponder described in the aforementioned U.S. Pat. No. 4,727,360, a frequency-divided response is not initiated below approximately 0.2 Oersteds.

I claim:

1. A frequency-dividing transponder for detecting electromagnetic radiation of a first predetermined frequency and responding to said detection by transmitting electromagnetic radiation of a second predetermined frequency that is a frequency-divided quotient of the first predetermined frequency, comprising an active strip of amorphous magnetic material having a transverse uniaxial anisotropy defining a magnetomechanical resonant frequency in accordance with the dimensions of the strip at the second predetermined frequency when magnetically biased to be within a predetermined magnetic field intensity range so as to respond to excitation by electromagnetic radiation of the first predetermined frequency by transmitting electromagnetic radiation of the second predetermined frequency; and a tripole strip of magnetic material of such coercivity and so disposed in relation to the active strip of magnetic material as to create a magnetomechanical resonance in the active strip at the first predetermined frequency when the active strip is magnetically biased to be within the predetermined magnetic field intensity range.

2. A transponder according to claim 1, wherein the tripole strip has a coercivity of at least 15 Oersteds.

3. A transponder according to claim 1, wherein the tripole strip has a coercivity in a range of from 15 to 200 Oersteds.

4. A transponder according to claim 1, further comprising a bipolar bias strip of magnetic material housed in common with the active strip and of such coercivity and so disposed in relation to the active strip of magnetic material as to cause the active strip of magnetic material to be within the predetermined magnetic field intensity range.

5. A transponder according to claim 1, wherein the amorphous magnetic material is selected from a group consisting of $Fe_{40}Ni_{38}Mo_4B_{18}$, $Fe_{82}B_{12}Si_6$, $Fe_{81}B_{13.5}Si_{3.5}C_2$ and $Fe_{67}Co_{18}B_{14}Si_1$.

6. A presence detection system, comprising means for transmitting electromagnetic radiation of a first predetermined frequency into a surveillance zone;

a tag for attachment to an article to be detected within the surveillance zone comprising a frequency-dividing transponder for detecting electromagnetic radiation of a first predetermined frequency and responding to said detection by transmitting electromagnetic radiation of a second predetermined frequency that is a frequency-divided quotient of the first predetermined frequency, including an active strip of amorphous magnetic material having a transverse uniaxial anisotropy defining a magnetomechanical resonant frequency in accordance with the dimensions of the strip at the second predetermined frequency when magnetically biased to be within a predetermined magnetic field intensity range so as to respond to excitation by electromagnetic radiation of the first predetermined frequency by transmitting electromagnetic radiation of the second predetermined frequency; and a tripole strip of magnetic material of such coercivity and so disposed in relation to the active strip of magnetic material as to create a magnetomechanical resonance in the active strip at the first predetermined frequency when the active strip is magnetically biased to be within the predetermined magnetic field intensity range;

means for causing the active strip of magnetic material to be within the predetermined magnetic field intensity range; and means for detecting electromagnetic radiation of the second predetermined frequency within the surveillance zone.

7. A system according to claim 6, wherein the tripole strip has a coercivity of at least 15 Oersteds.

8. A system according to claim 6, wherein the tripole strip has a coercivity in a range of from 15 to 200 Oersteds.

9. A system according to claim 6, wherein the means for causing the active strip of magnetic material to be within the predetermined magnetic field intensity range comprises a bipolar bias strip of magnetic material housed in common with the active strip and of such coercivity and so disposed in relation to the active strip of magnetic material as to cause the active strip of magnetic material to be within the predetermined magnetic field intensity range.

10. A system according to claim 6, wherein the amorphous magnetic material is selected from a group consisting of $Fe_{40}Ni_{38}Mo_4B_{18}$, $Fe_{82}B_{12}Si_6$, $Fe_{81}B_{13.5}Si_{3.5}C_2$ and $Fe_{67}Co_{18}B_{14}Si_1$.

11. A system according to claim 6, wherein the means for causing the active strip of magnetic material to be within the predetermined magnetic field intensity range includes a magnetic field source disposed adjacent or within the surveillance zone.

* * * * *